US009579675B2

(12) United States Patent
Foster et al.

(10) Patent No.: US 9,579,675 B2
(45) Date of Patent: Feb. 28, 2017

(54) PRE-COMPRESSION VALVE SYSTEMS FOR TRIGGER SPRAYERS

(75) Inventors: Donald D. Foster, St. Charles, MO (US); Philip L. Nelson, Wildwood, MO (US)

(73) Assignee: WestRock Dispensing Systems, Inc., Norcross, GA (US)

( * ) Notice: Subject to any disclaimer, the term of this patent is extended or adjusted under 35 U.S.C. 154(b) by 63 days.

(21) Appl. No.: 14/009,458

(22) PCT Filed: Apr. 4, 2012

(86) PCT No.: PCT/US2012/032133

§ 371 (c)(1),
(2), (4) Date: Oct. 2, 2013

(87) PCT Pub. No.: WO2013/106014

PCT Pub. Date: Jul. 18, 2013

(65) Prior Publication Data

US 2014/0014691 A1 Jan. 16, 2014

Related U.S. Application Data

(60) Provisional application No. 61/471,308, filed on Apr. 4, 2011.

(51) Int. Cl.
*B65D 88/54* (2006.01)
*B05B 11/00* (2006.01)
(Continued)

(52) U.S. Cl.
CPC ..... *B05B 11/304* (2013.01); *B05B 11/3011* (2013.01); *B05B 11/3064* (2013.01);
(Continued)

(58) Field of Classification Search
CPC ..... B65D 88/54; B67D 7/58; B05B 9/043; B05B 12/085; B05B 11/3009;
(Continued)

(56) References Cited

U.S. PATENT DOCUMENTS 3,981,622 A 9/1976 Hall et al.
3,987,529 A 10/1976 Nakagawa et al.
(Continued)

FOREIGN PATENT DOCUMENTS

CN 1256973 A 6/2000
CN 101767075 7/2010
(Continued)

OTHER PUBLICATIONS

EP Communication dated Nov. 5, 2014 for EP Application No. 12865409.2.
(Continued)

*Primary Examiner* — Paul R Durand
*Assistant Examiner* — Andrew P Bainbridge
(74) *Attorney, Agent, or Firm* — WestRock Intellectual Property Group

(57) ABSTRACT

Pre-compression valve systems for trigger sprayers include one-piece valve systems having both check and pre-compression valves or multiple component valve systems. The pre-compression valve is positioned in a vertical cylinder, and may have a flat, concave, or convex surface.

18 Claims, 9 Drawing Sheets

(51) Int. Cl.
*B05B 9/043* (2006.01)
*B05B 12/08* (2006.01)

(52) U.S. Cl.
CPC ..... *B05B 11/3077* (2013.01); *B05B 9/043* (2013.01); *B05B 11/305* (2013.01); *B05B 11/3009* (2013.01); *B05B 11/3016* (2013.01); *B05B 11/3043* (2013.01); *B05B 11/3045* (2013.01); *B05B 12/085* (2013.01); *B65D 88/54* (2013.01)

(58) Field of Classification Search
CPC ..... B05B 11/3043; B05B 11/3011; B05B 11/3016; B05B 11/305; B05B 11/3064; G01F 11/10
USPC ..... 239/333; 222/321.2, 321.7–321.9, 383.1, 222/383.3, 391, 633
See application file for complete search history.

(56) References Cited

U.S. PATENT DOCUMENTS 4,017,125 A 4/1977 Durling
4,050,746 A 9/1977 Durling
4,160,627 A 7/1979 Cole
4,214,677 A 7/1980 Bauer et al.
4,244,378 A 1/1981 Brignola
4,540,345 A 9/1985 Frazer
4,555,220 A 11/1985 Hall et al.
4,669,664 A * 6/1987 Garneau ..... 239/333
5,092,495 A 3/1992 Andre
5,186,481 A 2/1993 Turner
5,297,701 A 3/1994 Steijns et al.
5,425,476 A * 6/1995 Montaner et al. ..... 222/383.1
5,467,900 A * 11/1995 Maas ..... B05B 11/007 222/341
5,730,335 A * 3/1998 Maas ..... B05B 11/007 222/341
5,884,820 A * 3/1999 Thanisch ..... B05B 11/007 222/335
6,116,472 A * 9/2000 Wanbaugh ..... B05B 11/0016 222/340
6,126,038 A * 10/2000 Olegnowicz ..... B05B 11/3073 222/1
6,364,172 B1 * 4/2002 Maas ..... B05B 11/0005 222/340
6,378,739 B1 4/2002 Maas et al.
6,641,003 B1 * 11/2003 Foster ..... B05B 11/007 222/383.1
6,705,493 B1 * 3/2004 Mijers ..... B05B 11/0048 222/321.7
6,789,303 B2 9/2004 Maas et al.
7,517,568 B2 4/2009 Bitowft et al.
7,520,447 B2 4/2009 Engelen et al.
8,177,102 B2 5/2012 Hammond et al.
8,256,648 B2 9/2012 Maas et al.
8,677,799 B2 3/2014 Jamet
8,800,823 B2 8/2014 Sweeton
9,103,307 B2 8/2015 Lingener
9,132,441 B2 9/2015 Hoffman et al.
2002/0053577 A1 5/2002 Maas et al.
2005/0045658 A1 * 3/2005 Lee ..... B05B 11/3063 222/321.7
2005/0092778 A1 * 5/2005 Bistolfi ..... B05B 1/341 222/383.1
2005/0221113 A1 10/2005 Bitowft et al.
2006/0016910 A1 1/2006 Engelen et al.
2006/0054642 A1 * 3/2006 Buti ..... 222/383.1
2006/0083632 A1 4/2006 Hammond et al.
2006/0090973 A1 5/2006 Potas
2006/0175357 A1 8/2006 Hammond
2007/0295758 A1 * 12/2007 Foster et al. ..... 222/383.1
2008/0230563 A1 9/2008 Maas et al.
2009/0028734 A1 1/2009 Tseng
2009/0148342 A1 6/2009 Bromberg et al.
2009/0152304 A1 6/2009 Foster
2009/0308897 A1 * 12/2009 Foster et al. ..... 222/383.1
2011/0094280 A1 4/2011 Jamet
2011/0223040 A1 9/2011 Lingener
2012/0286057 A1 11/2012 Maas et al.
2012/0305119 A1 12/2012 Maas et al.
2013/0056499 A1 * 3/2013 Sweeton ..... B05B 11/3011 222/383.1
2013/0068797 A1 3/2013 Laidler et al.
2013/0341362 A1 12/2013 Hoffmann et al.
2014/0239018 A1 8/2014 Maas et al.
2015/0336123 A1 11/2015 Hoffmann et al.

FOREIGN PATENT DOCUMENTS

EP 0765689 4/1997
JP 9075798 A 3/1997
JP 9075800 A 3/1997
JP 9164350 A 6/1997
JP H11 42451 A 2/1999
JP H11 47650 A 2/1999
WO WO 2007/103922 9/2007
WO WO 2007/106809 9/2007

OTHER PUBLICATIONS

International Search Report from PCT/US2012/032133 dated Jun. 21, 2012.

* cited by examiner

PRE-COMPRESSION VALVE SYSTEMS FOR TRIGGER SPRAYERS

CROSS-REFERENCE TO RELATED APPLICATIONS

This application claims the benefit of, and priority to, U.S. Provisional Application No. 61/471,308, entitled "PRE-COMPRESSION VALVE SYSTEM IN AN ALL PLASTIC DISPENSER WITH A LOCKING PRE-LOAD, UTILIZING A GASKET RETENTION DESIGN AND A TAB PRE-LOADED SPRING," filed Apr. 4, 2011, and incorporates the same herein by reference in its entirety.

BACKGROUND OF THE INVENTION

Field of the Invention

Embodiments of the present invention relate to trigger sprayers and in particular to pre-compression type trigger sprayers.

State of the Art

Trigger sprayers and their uses are well known. In some instances, it is desirable to prevent discharge of a trigger sprayer until a certain pressure—or pre-compression—has been applied to the fluid to be discharged by a trigger sprayer. Various systems have been developed to accomplish such pre-compression features. However, it is desirable to develop new pre-compression configurations which may be easier or more cost efficient to produce and manufacture.

BRIEF SUMMARY OF THE INVENTION

According to certain embodiments of the invention, a pre-compression trigger sprayer may be made of all plastic materials and can be manufactured to dispense in a large range of outputs in spray, stream or foam dispensing patterns. This design can be used to dispense many liquid products from air fresheners, window cleaners, household chemicals, lawn and garden products, automotive products, or other products.

In some embodiments of the invention, a trigger sprayer is of the type wherein structure is provided for preventing pressurizes liquid from being expelled from an outlet orifice in a nozzle of a trigger sprayer until a predetermined pressure of the liquid is reached in a pumping cylinder and the ejection of liquid in a spray, stream or a foam is stopped or cut off when the pressure of the liquid being pumped by the trigger sprayer in the pumping cylinder falls below a predetermined pressure.

In still further embodiments, a trigger sprayer may include a pre-compression valve system located in a vertical cylinder behind the horizontal pumping cylinder of a trigger sprayer.

In further embodiments, a tab on a plastic return spring may be included for increasing the load against the arms of the spring and a locking system may be incorporated that provides a constant pre-load on the pre-compression valve system.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
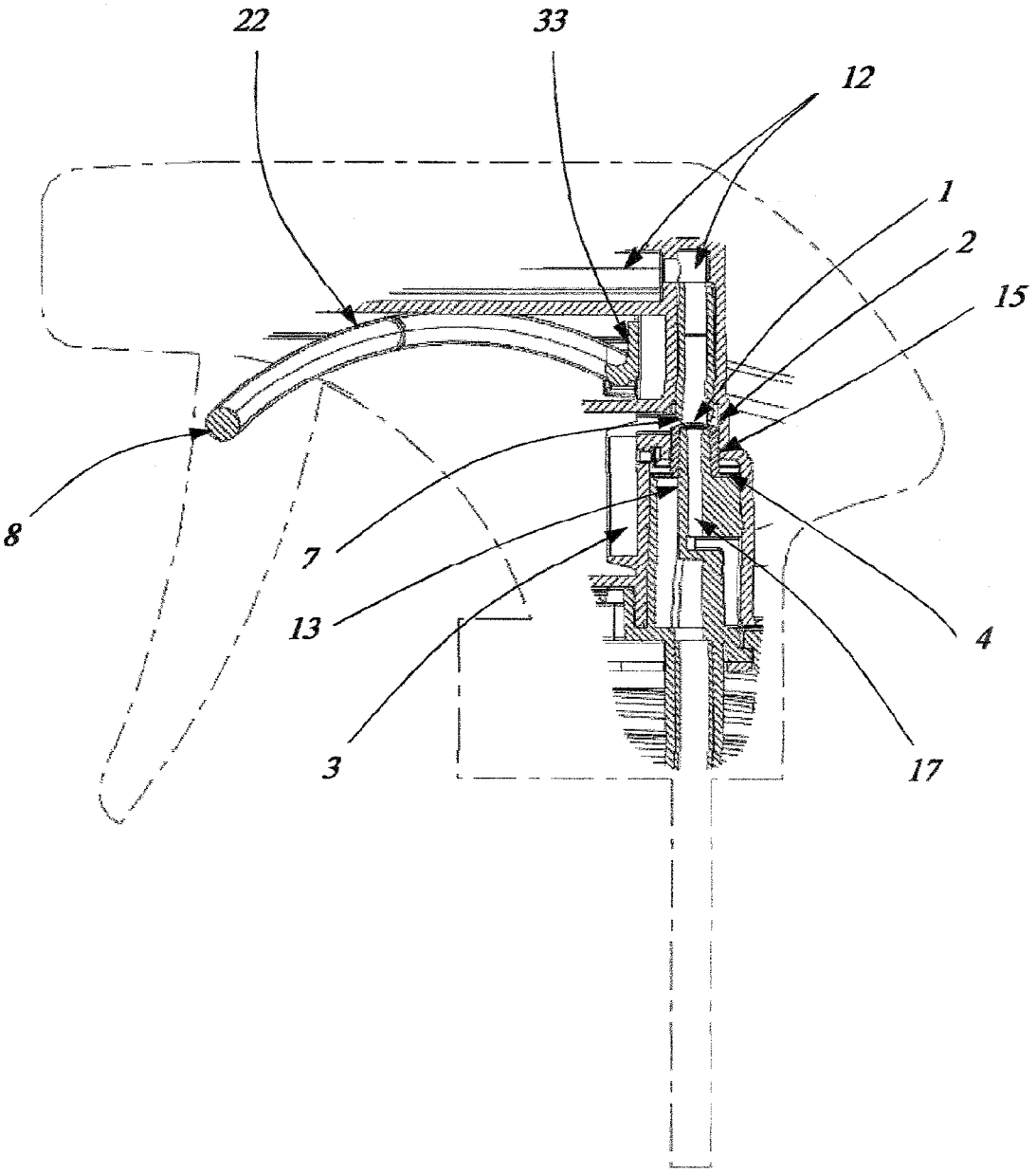
FIG. 1 illustrates a cross-sectional view of a trigger sprayer according to embodiments of the present invention.
Figure 2:
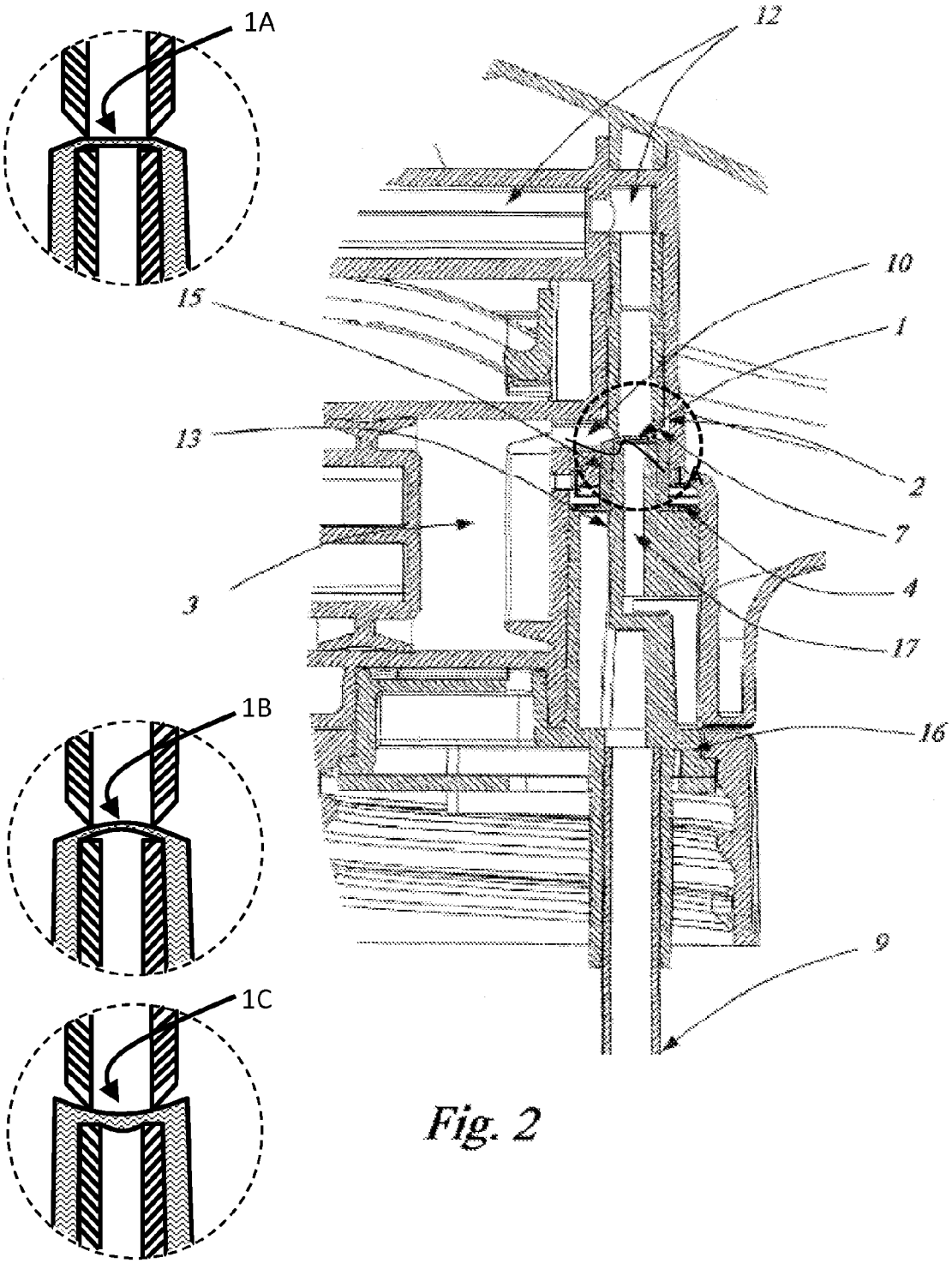
FIG. 2 illustrates an enlarged cross-sectional view of a pre-compression system according to various embodiments of the invention.
Figure 3:
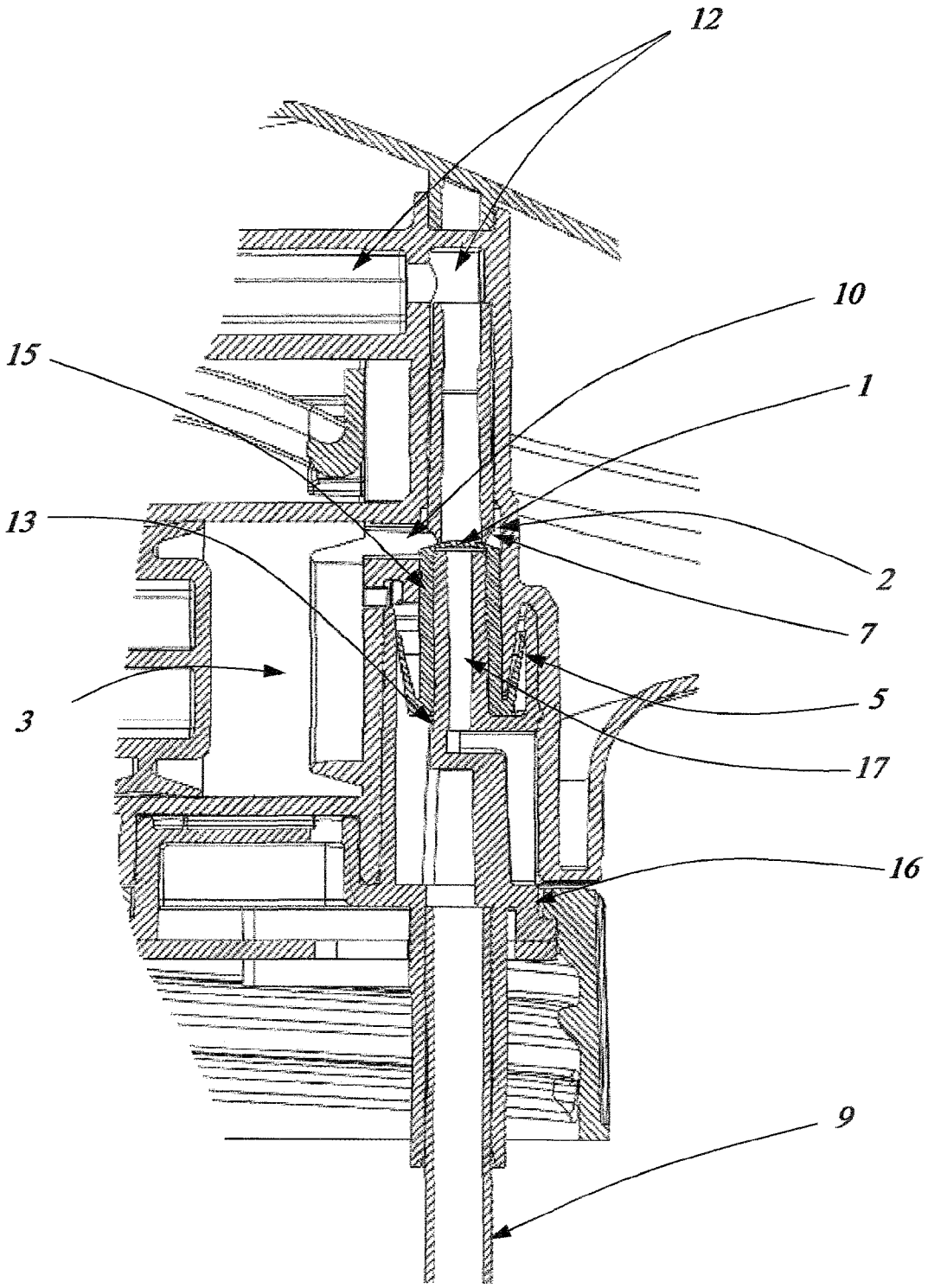
FIG. 3 illustrates an enlarged cross-sectional view of a pre-compression system according to various embodiments of the invention.
Figure 4:
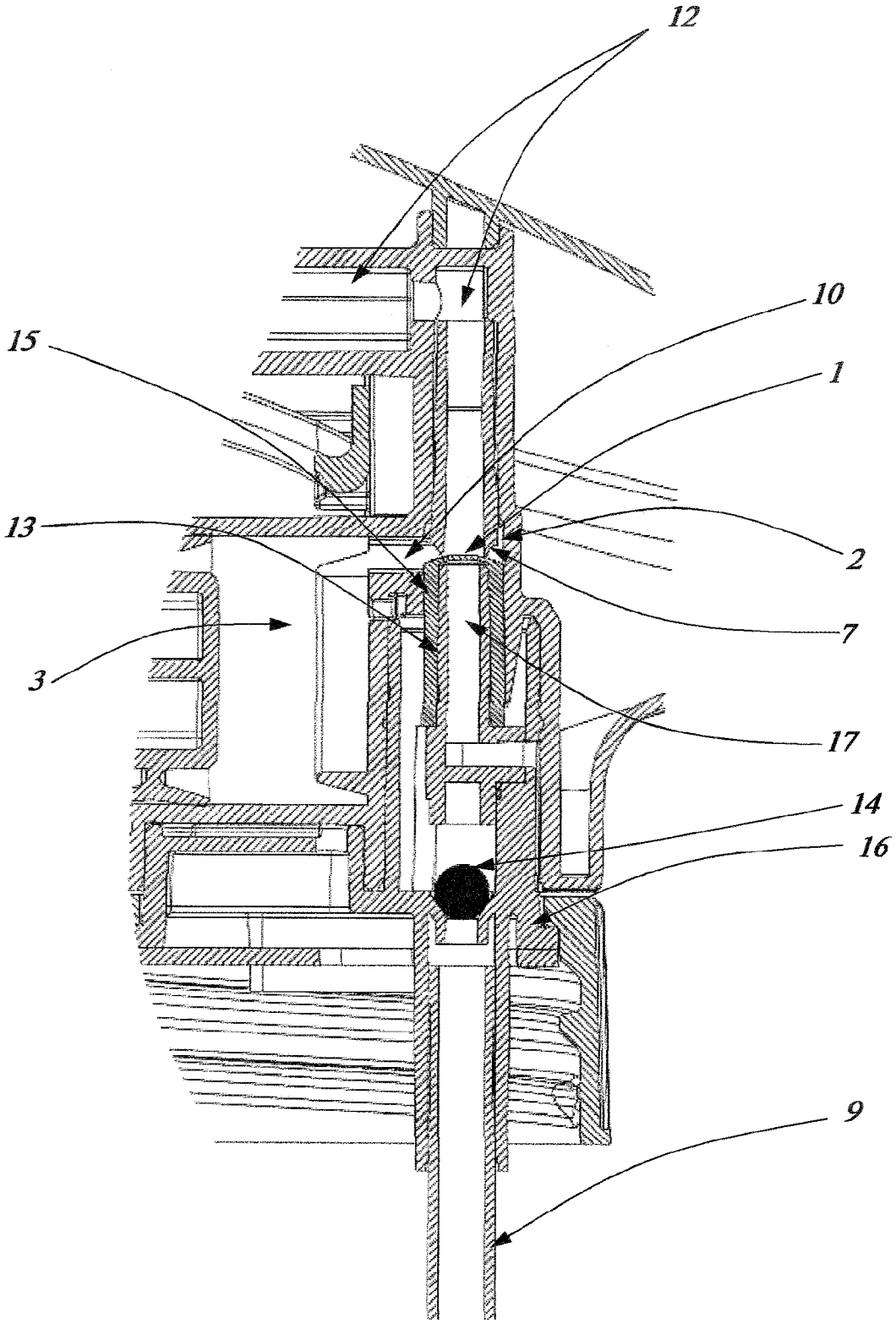
FIG. 4 illustrates an enlarged cross-sectional view of a pre-compression system according to various embodiments of the invention.

According to various embodiments of the invention, a pre-compression trigger sprayer may include any configuration as shown in FIGS. 1 thru 11. A pre-compression trigger sprayer according to various embodiments may include an open and closed opposing valve system where the pre-compression valve 1 is located in a vertical cylinder 2, or fluid flow path, behind the horizontal pumping cylinder 3, or piston chamber. Located below the pre-compression valve 1 is a check valve 4. The check valve 4 can be part of the pre-compression valve system shown in FIG. 2 as a disc type valve 4 or as in FIG. 3 as a frusto-conical shaped valve 5 or as in FIG. 4 as a separate valve 14 or many other configurations that would serve as a one way check valve system preventing liquid under pressure or at rest returning back into the container from which it was once drawn when a vacuum was created inside of the pumping cylinder 3.

A pre-compression valve 1, as shown in FIG. 1, can have a flat, concave or convex shape. FIG. 1 shows a valve 1 in a trigger sprayer however this valve system could be used in any opposing valve dispenser. The pre-compression valve system shown in FIG. 1 requires a predetermined pressure to allow liquid to pass between valve 1 and the valve seat 7. This occurs when a vacuum is created in the pumping cylinder 3 by the movement of the piston to the front portion of the pumping cylinder which has been forced back by a spring biasing component 8. The vacuum draws the liquid up the dip tube 9 from the container and passes the check valve 4 into the pumping cylinder 3. Then, once the piston is moved to the back portion of the pumping cylinder 3 the liquid that was drawn into the pumping cylinder 3 is compressed and forces the liquid in area 10 to compress the top portion of pre-compression valve 1 allowing liquid to travel past the pre-compression valve 1 and valve seat 7 of component 11 into the flow channel 12 then exit the nozzle swirl orifice as a spray, foam or accelerated stream.

In some embodiments, a one piece pre-compression valve system as shown in FIG. 1 may include a priming valve portion 1 and the check valve portion 4 molded from flexible plastic materials which may allow the valve portions of the system to move freely under pressure or vacuum. This is not however desirable for the non-valve area 15 of the structure. Movement of the non-valve area 15 can reduced the overall effectiveness of the pre-compression valve system. Embodiments of the present invention may overcome this problem by inserting post 13 of valve case 16 which is made of a harder material inside of the pre-compression valve system. Inserting the harder material valve case post 13 into non-valve area 15 may also eliminate the requirement to mold the pre-compression valve system component in two different materials, thus reducing the manufacturing cost. Channel 17 inside post 13 of the valve case 16 may also serve as conduit to allow normal atmosphere outside air pressure to enter behind the pre-compression valve 1 allowing the pre-compression valve 1 to move freely without concern of a vacuum or compressed trapped air on the opposite side of the pre-compression valve 1.

Figure 5:
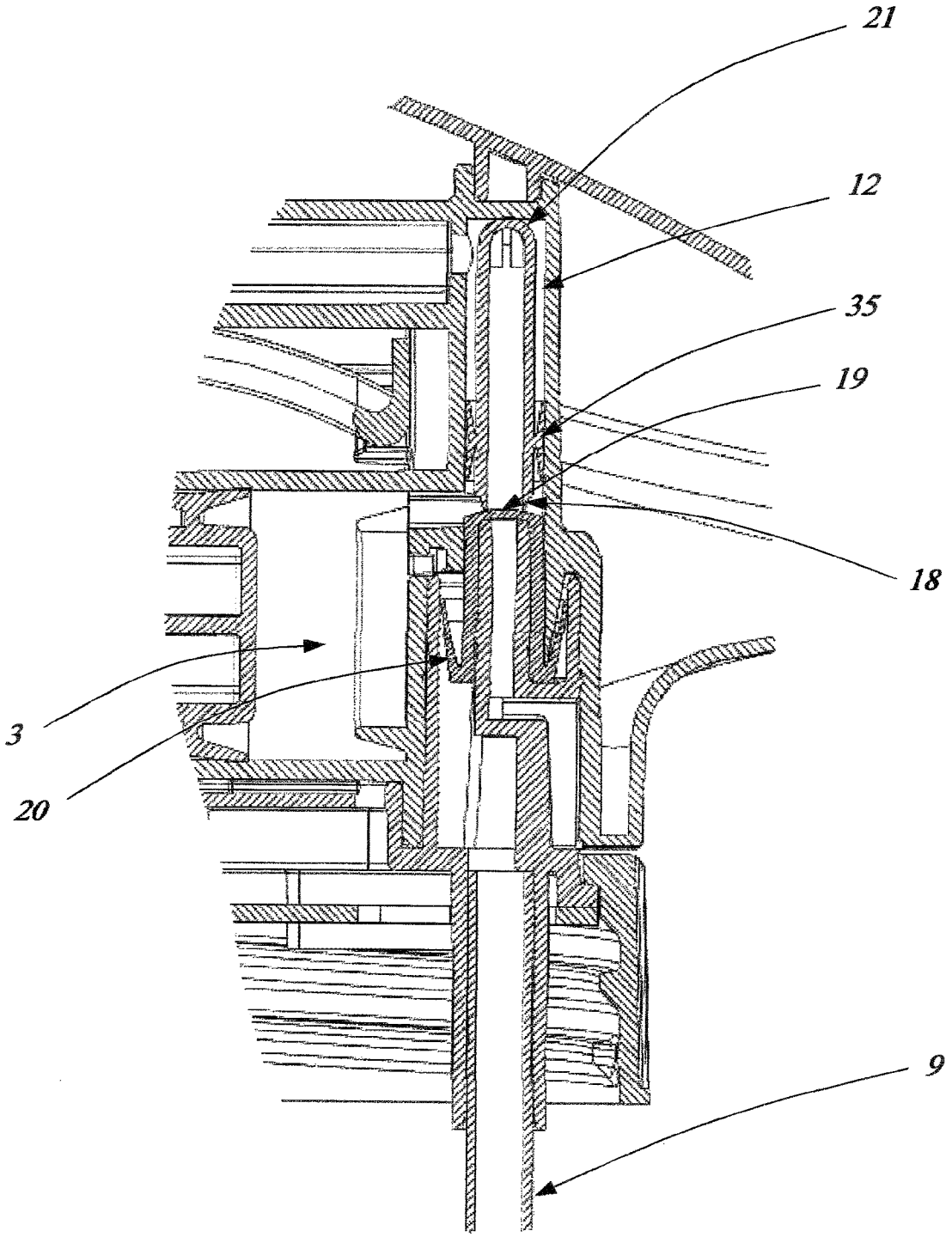
FIG. 5 illustrates an enlarged cross-sectional view of a pre-compression system according to various embodiments of the invention.

The pre-compression valve system shown in FIG. 5 is an optional design for the valve seat 18. In this embodiment, the priming valve 19 which is part of the lower check valve 20, or which could be made of a separate component, does not move. Instead the valve seat 18 moves upward against a bias spring element 21. This movement does not occur until a predetermined pressure of the liquid is reached in the pumping cylinder 3 as described before. The moving valve seat 18 embodiment may require a sealing means 35 between the moving valve seat 18 and the inside diameter of flow channel 12. This design may also be reversed where the valve portion replaces the valve seat 18 and is part of the upper bias spring element 21 and moves upwards and the valve seat portion replaces the priming valve 19 and is part of the lower check valve 20 and does not move.

Figure 6:
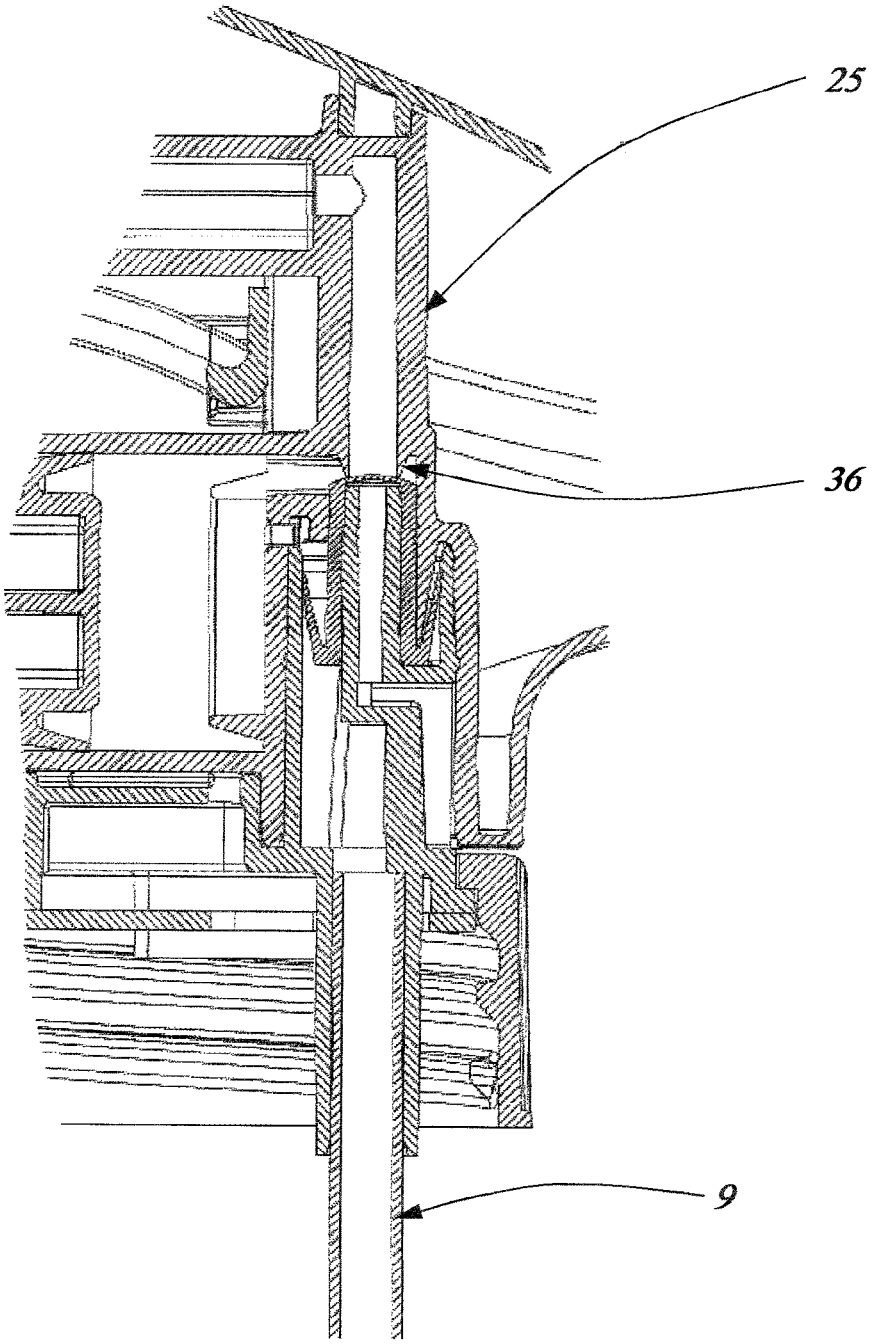
FIG. 6 illustrates an enlarged cross-sectional view of a pre-compression system according to various embodiments of the invention.

FIG. 6 illustrates another embodiment which may include a cost reduction option which eliminates the separate valve seat component 11 shown in the pre-compression valve system of FIG. 1. In this embodiment the valve seat 36 may be part of the housing 25. The pre-compression valve system shown in FIG. 6 functions the same as the pre-compression valve system shown in FIGS. 1, 2, 3 and 4.

Figure 7A:
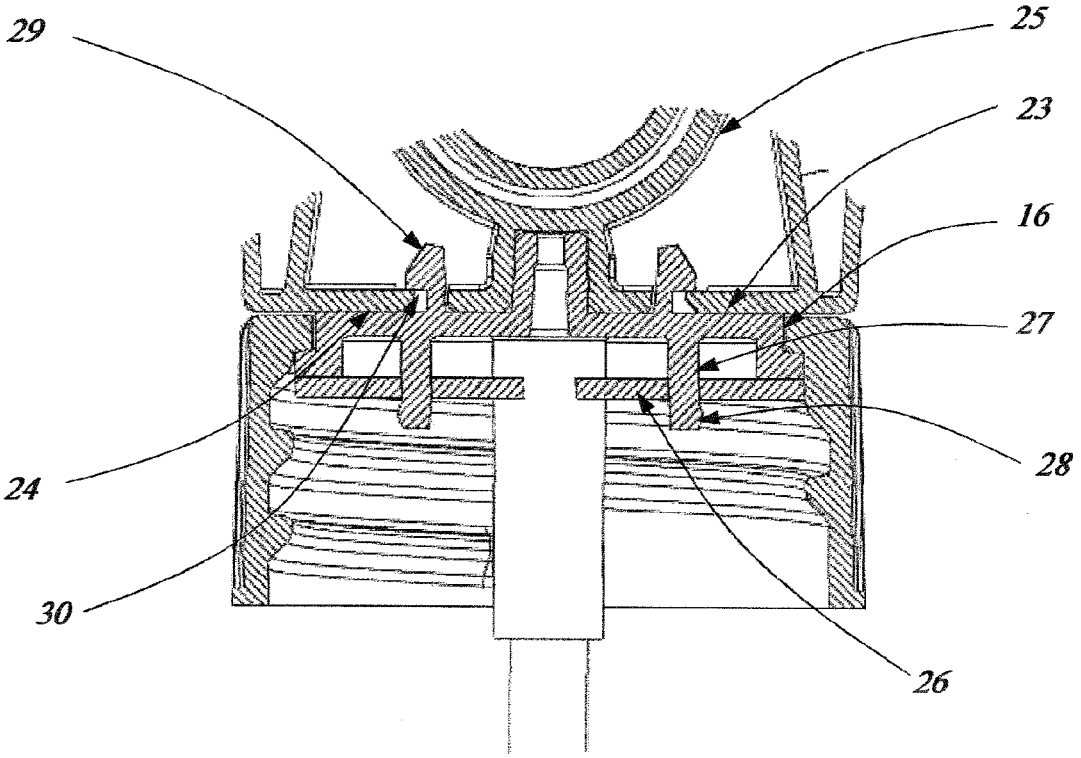
FIG. 7A illustrates a gasket assembly with a trigger sprayer according to embodiments of the invention.
Figure 7:
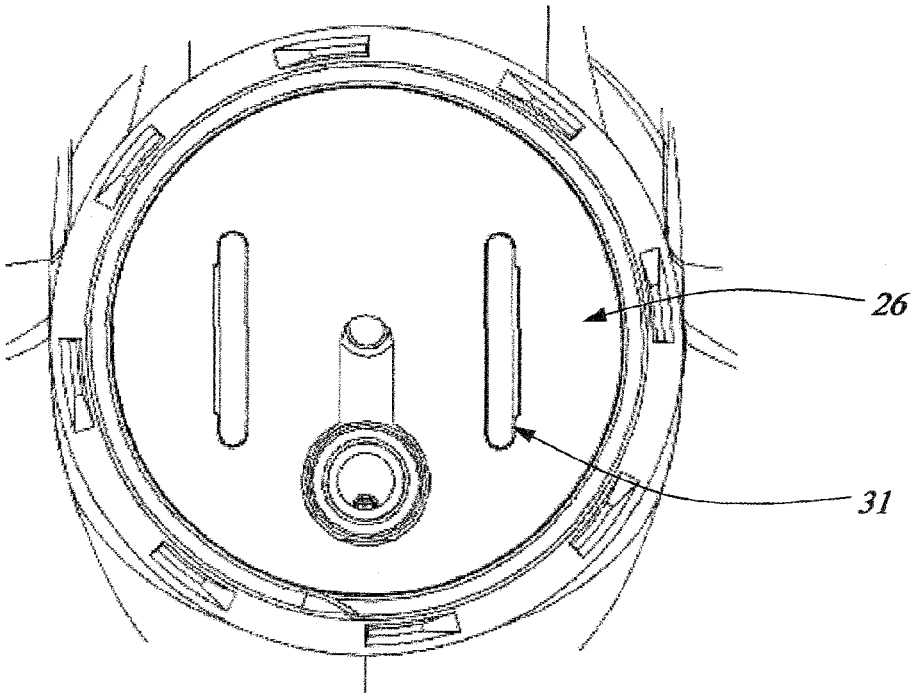
FIG. 7 illustrates a gasket for a trigger sprayer according to embodiments of the invention.

The positive lock pre-compression valve pre-load design shown in FIG. 7 provides a constant load between surface 23 of valve case 16 and surface 24 of housing 25 preventing movement of pre-compression valve system which is assembled into valve case 16 and housing 25. Undercuts 29 on housing 25 are snapped through slots 30 in valve case 16 under a preload interference. Movement of the pre-compression valve system may result in inconsistency of stokes to prime, of liquid volume output, and of the spray/foam/stream patterns produced from the dispensing system.

A positive lock gasket retention system for a closure is shown in FIGS. 7 and 7A. Gasket 26 may be retained in place through slots 31 in gasket 26 with ribs 21 and undercuts 28 of valve case 16.

Figure 8A:
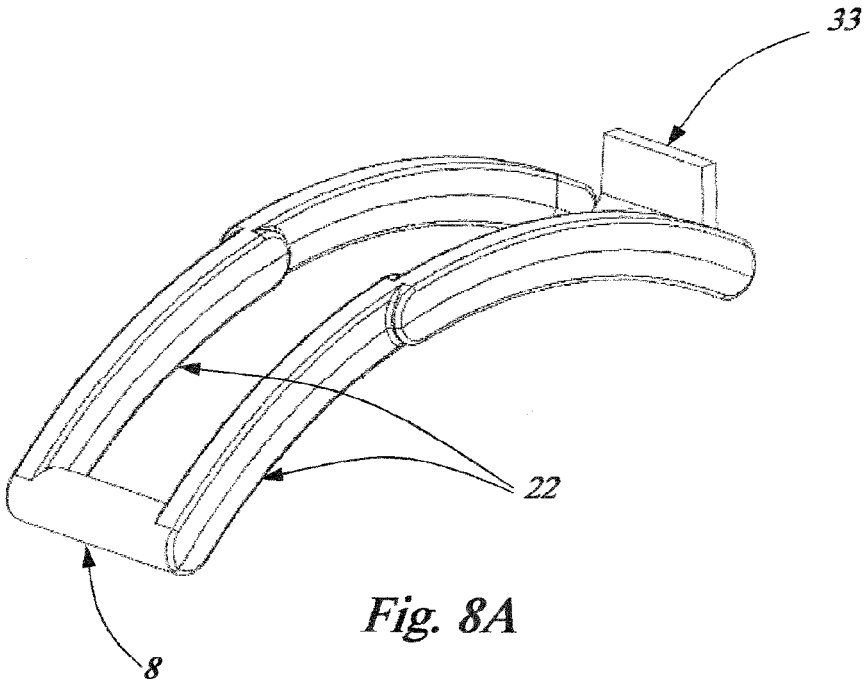
FIG. 8A illustrates a spring according to various embodiments of the invention.
Figure 8:
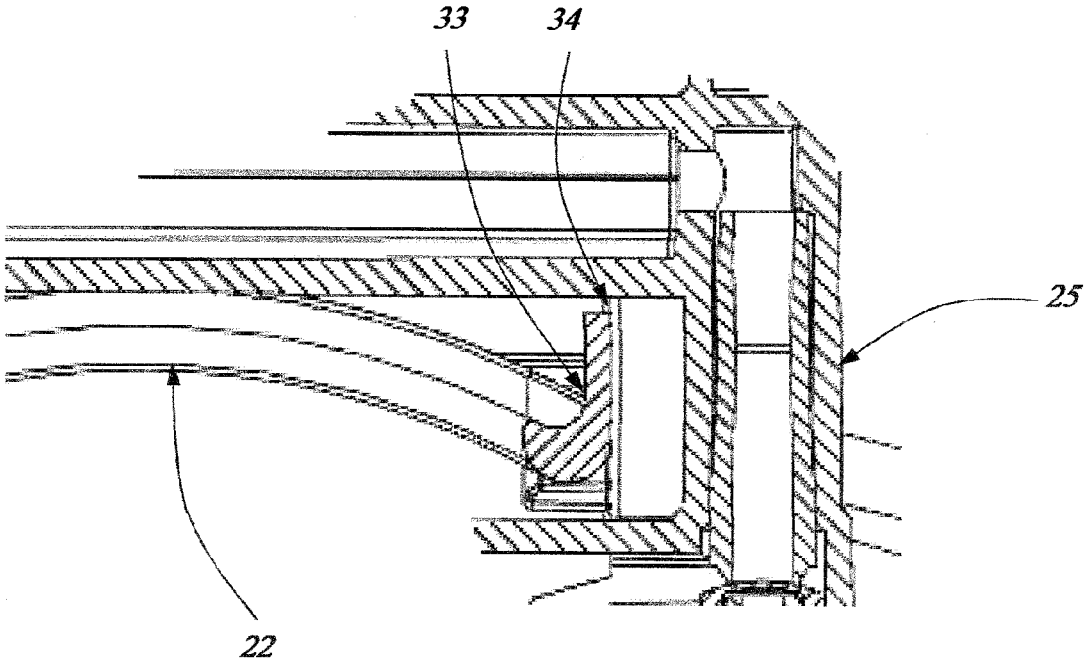
FIG. 8 illustrates a cross-sectional view of a spring assembled with a trigger sprayer according to various embodiments of the invention.
Figure 11:
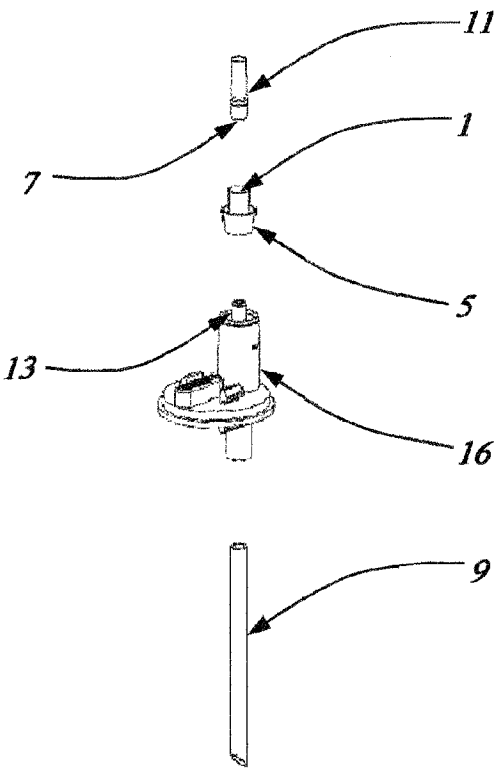
FIG. 11 illustrates an exploded view of the components illustrated in FIG. 3.
Figure 10:
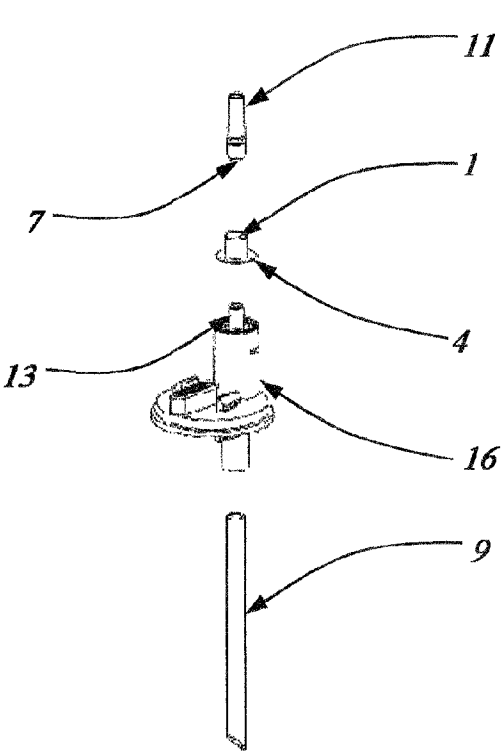
FIG. 10 illustrates an exploded view of the components illustrated in FIG. 2.
Figure 9:
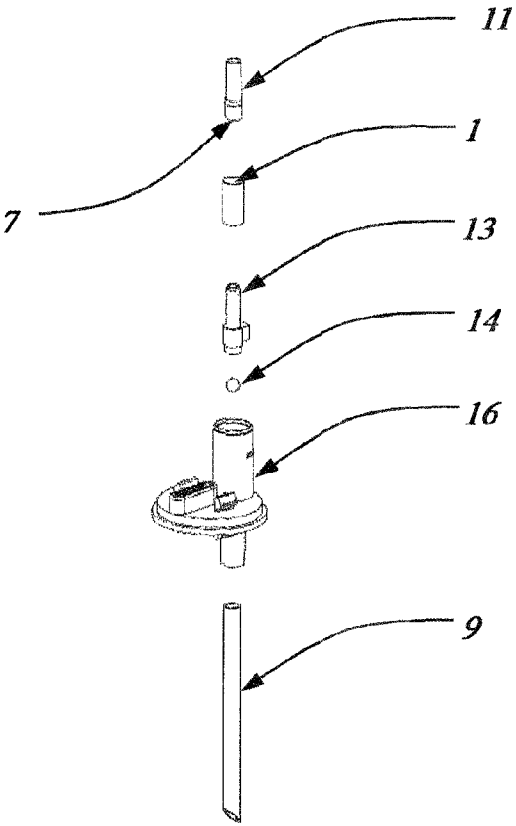
FIG. 9 illustrates an exploded view of the components illustrated in FIG. 4.

A bias loaded assist tab 33 on the plastic spring component 8 according to various embodiments of the invention, is shown in FIG. 8 and provides pressure against the housing surface 34 to assist the spring arms 22 of the plastic spring component 8 on the return vacuum stroke of the piston/actuator creating a vacuum in the pumping cylinder 3 which allows product to be drawn into the pumping cylinder 3. This process may be repeated over and over which puts stress on the plastic spring arms 22 of the plastic spring component 8 which can break or lose the ability to fully return the piston on the return vacuum stroke. Inclusion of a tab 33 according to embodiments of the invention, increases the strength of the overall plastic spring component 8 thus reducing the stress on the arms 22.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pre-compression valve system, comprising:

a unitary check valve and pre-compression valve, comprising a tubular body with an open lower end and a closed upper end; a post inserted inside the tubular body through the open lower end;

wherein the check valve controls fluid flow into a pumping cylinder and the pre-compression valve is positioned in a vertical cylinder in communication with the pumping cylinder, the pre-compression valve opening only when a predetermined pressure exists within the pumping cylinder, the vertical cylinder having an axis extending from a view point beyond the pre-compression valve, past the pre-compression valve, and toward the check valve, and wherein the pre-compression valve has a convex sealing surface as viewed from the view point in the vertical cylinder.

2. A unitary pre-compression valve for a trigger sprayer, comprising:

a check valve; and a pre-compression valve connected to the check valve; comprising a tubular body with an open lower end and a closed upper end; a post inserted inside the tubular body through the open lower end;

wherein the pre-compression valve is positioned in a vertical cylinder in communication with a pumping cylinder, the vertical cylinder having an axis extending from a view point beyond the pre-compression valve, past the pre-compression valve, and toward the check valve, wherein the pre-compression valve has a sealing surface facing toward the view point in the vertical cylinder, and wherein the pre-compression valve opens only when a predetermined pressure exists within the pumping cylinder.

3. The unitary pre-compression valve of claim 2, wherein the unitary pre-compression valve is formed of a flexible plastic material.

4. The unitary pre-compression valve of claim 2, wherein the pre-compression valve has a flat surface as viewed from the view point in the vertical cylinder.

5. The unitary pre-compression valve of claim 2, wherein the pre-compression valve has a concave surface as viewed from the view point in the vertical cylinder.

6. The unitary pre-compression valve of claim 2, wherein the pre-compression valve has a convex surface as viewed from the view point in the vertical cylinder.

7. The unitary pre-compression valve of claim 6, further comprising a valve seat against which the pre-compression valve is seated.

8. The unitary pre-compression valve of claim 7, wherein the valve seat is provided by a valve seat component positioned in the vertical cylinder and above the pre-compression valve.

9. The unitary pre-compression valve of claim 7, wherein the valve seat is formed in the wall of the vertical cylinder.

10. The unitary pre-compression valve of claim 2, wherein the check valve is a frusto-conical shaped check valve.

11. A pre-compression valve system, comprising:

a unitary check valve and pre-compression valve, comprising a tubular body with an open lower end and a closed upper end; a post inserted inside the tubular body through the open lower end;

wherein the check valve is positioned at the lower end and controls fluid flow into a pumping cylinder; and wherein the pre-compression valve is located at the upper end and is positioned in a vertical cylinder in communication with the pumping cylinder, the vertical cylinder having an axis extending from a view point beyond the pre-compression valve, past the pre-compression valve, and toward the check valve, wherein the pre-compression valve has a convex sealing surface facing toward the view point in the vertical cylinder, wherein the pre-compression valve opens only when a predetermined pressure exists in the pumping cylinder, and wherein the pre-compression valve has a convex surface as viewed from the view point in the vertical cylinder.

12. The pre-compression valve system of claim 11, wherein the unitary pre-compression valve is formed of a flexible plastic material.

13. The pre-compression valve system of claim 11, further comprising a channel inside the post.

14. The unitary pre-compression valve system of claim 11, further comprising a valve seat against which the pre-compression valve is seated.

15. The unitary pre-compression valve system of claim 14, wherein the valve seat is provided by a valve seat component positioned in the vertical cylinder and above the pre-compression valve.

16. The unitary pre-compression valve system of claim 14, wherein the valve seat is formed in the wall of the vertical cylinder.

17. The pre-compression valve system of claim 11, wherein the check valve is a frusto-conical shaped check valve.

18. A pre-compression valve system, comprising:

a unitary check valve and pre-compression valve, comprising a tubular body with an open lower end and a closed upper end;

a post inserted inside the tubular body through the open lower end;

a channel inside the post, wherein the channel serves as a conduit to allow normal atmosphere outside air pressure to enter the tubular body;

wherein the check valve is a frusto-conical shaped check valve positioned at the lower end and controls fluid flow into a pumping cylinder; and wherein the pre-compression valve is located at the upper end and is positioned in a vertical cylinder in communication with the pumping cylinder.

* * * * *